US010874200B2

(12) United States Patent
Laskin et al.

(10) Patent No.: US 10,874,200 B2
(45) Date of Patent: Dec. 29, 2020

(54) CIGAR HOLDER AND METHOD

(71) Applicants: Hardy A. Laskin, Phoenix, AZ (US); Ryan James Murray, Phoenix, AZ (US)

(72) Inventors: Hardy A. Laskin, Phoenix, AZ (US); Ryan James Murray, Phoenix, AZ (US)

(73) Assignee: Garclip LLC, Phoenix, AZ (US)

( * ) Notice: Subject to any disclaimer, the term of this patent is extended or adjusted under 35 U.S.C. 154(b) by 252 days.

(21) Appl. No.: 14/332,713

(22) Filed: Jul. 16, 2014

(65) Prior Publication Data

US 2016/0015159 A1 Jan. 21, 2016

(51) Int. Cl.

| | |
|---|---|
| ***A45F 5/00*** | (2006.01) |
| ***A45F 5/02*** | (2006.01) |
| ***A24D 1/12*** | (2006.01) |

(52) U.S. Cl.

CPC ..... *A45F 5/02* (2013.01); *A24D 1/12* (2013.01); *A45F 2200/0566* (2013.01)

(58) Field of Classification Search

CPC .. A45F 5/02; A45F 5/021; A24F 13/02; A24F 13/22; B60R 11/00

USPC ..... 224/181, 268, 269

See application file for complete search history.

(56) References Cited

U.S. PATENT DOCUMENTS 2,644,212 A * 7/1953 Markowitz ..... B43K 23/001 223/109 A
3,178,784 A * 4/1965 Krauthamer ..... B43K 23/001 2/250
5,025,966 A * 6/1991 Potter ..... A45F 5/02 224/183
5,524,646 A * 6/1996 Reich ..... A24F 13/22 131/256
5,643,114 A 7/1997 Marcus
5,706,832 A 1/1998 Gold
5,816,262 A 10/1998 Javnozon
5,865,482 A * 2/1999 Aoki ..... A45C 13/1069 24/303
D408,097 S * 4/1999 Heydt ..... D27/183

(Continued)

OTHER PUBLICATIONS

"CigarMinder", Tobacco Products International, Quarter 4, 2012, 5 pages.

(Continued)

*Primary Examiner* — Peter N Helvey
(74) *Attorney, Agent, or Firm* — Haynes and Boone, LLP

(57) ABSTRACT

A cigar holder includes a first member having a retainer secured to a first base for extending about a cigar. The first base includes a magnet. A second member includes a clip secured to a second base for fastening to a hat. The second base includes a metallic member. Magnetic coupling between the first and second base members allows relative rotation therebetween to position the cigar at a desired orientation. The retainer and first base member may be integrally molded from plastic material. The clip and second base member may be integrally molded from plastic material. The retainer encircles the cigar through an angular arc of at least 200 degrees. A method of supporting a cigar from a user's hat includes releasably securing the retainer about the cigar, coupling the clip around a portion of the user's hat, and positioning the first base proximate to the second base.

16 Claims, 2 Drawing Sheets

(56) References Cited

U.S. PATENT DOCUMENTS

| | | | | |
|---|---|---|---|---|
| 6,050,268 | A * | 4/2000 | San Filippo | A24F 13/22 131/187 |
| 6,234,916 | B1 | 5/2001 | Carusillo et al. | |
| 6,363,941 | B1 | 4/2002 | Combs | |
| 6,530,510 | B2 | 3/2003 | Ferrari | |
| 6,551,539 | B1 * | 4/2003 | Leach | A44B 18/0049 156/244.15 |
| 6,572,495 | B1 | 6/2003 | Ferrari | |
| 6,691,905 | B2 | 2/2004 | Berdan | |
| 6,964,361 | B2 * | 11/2005 | Kathrein | A45C 1/04 224/183 |
| 6,994,639 | B2 | 2/2006 | Parks et al. | |
| 7,766,769 | B2 | 8/2010 | Lueders | |
| D663,476 | S * | 7/2012 | Kelly | D27/183 |
| 2004/0237262 | A1 * | 12/2004 | Arnone | B43K 23/002 24/10 R |
| 2005/0223525 | A1 * | 10/2005 | Wartian | A42B 1/24 24/3.12 |
| 2006/0282993 | A1 * | 12/2006 | Dietz | A45C 11/34 24/303 |
| 2007/0261705 | A1 | 11/2007 | Myers | |
| 2010/0327031 | A1 * | 12/2010 | Olmos | A45F 5/02 224/269 |
| 2011/0253154 | A1 | 10/2011 | Dolciato | |
| 2014/0043580 | A1 * | 2/2014 | Steele | G02C 7/14 351/50 |
| 2014/0331388 | A1 * | 11/2014 | Nunan | A45F 5/02 2/244 |

OTHER PUBLICATIONS

"Get a Grip Cigar Clip" Trademark No. 3,762,6212, generated by TSDR on Mar. 18, 2016, 4 pages.

"B0019HVQ2E Get-A-Grip Clip Cigar Holder", Read Reviews Callaway, May 9, 2010, pp. 1-2.

* cited by examiner

CIGAR HOLDER AND METHOD

BACKGROUND OF THE INVENTION

1. Field of the Invention

The present invention relates generally to apparatus for supporting cigars while outdoors, for example, on a golf course, and more particularly, to an apparatus and method for conveniently supporting a cigar upon the user's person in a manner that eliminates the likelihood that the user will inadvertently forget the cigar while engaged in other activities, like golfing.

2. Description of the Relevant Art

Many golfers enjoy smoking cigars while out on the golf course. Smoking of cigars indoors is often restricted or prohibited, or simply impractical to avoid offending others. Thus, golfers who enjoy a cigar look forward to smoking cigars while in the open outdoors of the golf course.

Most cigar smokers hold a cigar in their hand, except when it is time for the golfer to take his or her next golf shot. When preparing to tee-up a golf ball on the tee, taking a shot from the fairway, or lining up a putt, the golfer usually throws the cigar down on the ground temporarily to free-up the golfer's hands. After taking the shot, the golfer retrieves the cigar from the ground. Unfortunately, it often happens that the golfer is so focused on the golf shot that the golfer just completed that the golfer forgets the cigar lying on the ground, and drives off in a golf cart toward the golf ball. Quality cigars cost upwards of $35 or more per cigar, and the aggravation to a golfer caused by forgetting a cigar at the prior hole is only matched by the disappointment felt after making a bad shot. Moreover, placement of the cigar on the ground may cause the outer leaves of the cigar to become wet, or to become contaminated with chemicals applied by groundskeepers.

Others have attempted to address this problem in the past with varying degrees of success. Accessories for supporting a cigar upon the ground are disclosed, for example, in U.S. Pat. No. 5,643,114 to Marcus; U.S. Pat. No. 6,363,941 to Combs; U.S. Pat. No. 6,234,916 to Carusillo, et al.; U.S. Pat. No. 5,816,262 to Javnozon; U.S. Pat. No. 6,691,905 to Berdan; and U.S. Pat. Appn. Publ. No. 2011/0253154 to Dolciato.

In U.S. Pat. No. 6,994,639 to Parks, et al., a magnet golf divot tool is disclosed. The patent describes the divot tool for use in cradling a cigar from the head of a golf club, or upon the ground.

U.S. Pat. No. 5,706,832 to Gold discloses a cigar holder which includes a mechanical clamp that may be used to mount the device to a golf cart.

In U.S. Pat. No. 6,530,510 to Ferrari, a cigar holder is provided for securing a cigar from a post of a golf cart. A first strap that supports a magnet is secured around a cigar, as by using Velcro-brand fastening material. A second strap that includes either a magnet or metallic disk is secured around a post of a golf cart. When it is desired to support the cigar from the golf cart post, the user brings the magnet of the first strap proximate the magnetic or metallic disk of the second strap. While this arrangement may be sufficient for golfers who are content to leave their cigars at the golf cart, many golfers prefer to bring their cigars with them to the location of their golf balls. This is particularly true when a foursome is gathering at the tee, or on a putting green, when it may take five minutes or more for the foursome to complete their shots. When a course is crowded, and golfers must wait for the party ahead to move on before teeing off, the wait times further increase.

In U.S. Pat. No. 6,572,495, also to Ferrari, a multi-purpose golfer's tool is described which includes a cigar cutter and a ball mark repair blade. Ferrari states that such device may include a magnet that can be used to secure a cigar having one of the magnetic straps described in his '510 patent mentioned above. Ferrari further describes supporting the cigar slightly above the ground by sticking a pair of tines into the turf. This feature may permit a golfer to bring a cigar to the tee, or to the putting green, rather than leaving the cigar at the cart, while keeping the cigar above the ground. However, it is still likely that the golfer will forget the cigar on the ground while trying to follow his or her shot, and drive off without it.

U.S. Pat. No. 7,766,769 to Lueders discloses a multi-function golf tool that includes a clip for attachment to the visor of a golf hat. The visor clip includes a magnet, and a golfing tool can be magnetically attracted to the magnet of the visor clip when the tool is not in use. Lueders further states that the tool includes a "thumb rest" which can be used as a cigar holder, though Lueders does not disclose how one retains a cigar upon such thumb rest.

Finally, U.S. Pat. Appn. Publ. No. 20070261705 to Myers discloses a single-piece clip for supporting a cigar from the side of the user's hat or cap. While this device keeps the cigar on the user's person at all times, placement of the cigar into the clip, and removal of the cigar from the clip, are cumbersome. In addition, the clip is capable of supporting the cigar in only one orientation, thereby causing the cigar to be a distraction to the user's peripheral vision while making golf shots.

Accordingly, it is an object of the present invention to provide a cigar holder that conveniently supports a cigar upon the user's person during those times when the user must have both of his or her hands free.

It is a further object of the present invention to provide such a cigar holder that virtually eliminates the likelihood that the user will inadvertently forget the cigar while engaged in other activities, like golfing.

Another object of the present invention is to provide such a cigar holder that avoids contact between the cigar wrapping and the ground.

Still another object of the present invention is to provide such a cigar holder which allows a golfer to bring a cigar along with the golfer to the tee, to the putting green, and/or to the fairway location where a ball has been shot, while still being immediately ready to support the cigar when needed.

Yet another object of the present invention is to provide such a cigar holder that securely supports the cigar in a position that is not distracting to the user, while allowing the user to easily retrieve the cigar for smoking when the user's hands are free once more.

These and other objects of the invention will become more apparent to those skilled in the art as the description of the present invention proceeds.

SUMMARY OF THE INVENTION

Briefly described, and in accordance with a preferred embodiment thereof, the present invention relates to a cigar holder for supporting a cigar from a golfer's hat or other article, and including first and second members, sometimes referred to herein as first and second components. The first member, or cigar portion, includes a base having a metallic member that is preferably a magnet; the base supports a retainer secured thereto to releasably extend about a cigar, thereby releasably securing the cigar to the first member. The cigar retainer is preferably made from a flexible plastic material like nylon that is resilient, and which has a "memory" for returning to its original configuration after being deformed. It is preferred that the retainer of the first member is formed integrally with the base of the first member. In the preferred embodiment, the cigar retainer is provided in the form of a split band that sweeps through an angular arc of at least 200 degrees; the cigar may be inserted into, or removed from the retainer, through the split in the band.

The second member, or hat portion, also includes a base having a metallic member, preferably a second magnet, for being attracted to the first magnet included in the base of the first member. The magnetic attraction between the magnet in the base of the first member and the metallic member in the base of the second member serves to releasably secure the base of the second member to the base of the first member when they are positioned proximate to each other. The second member includes a clip extending from the base of the second member; this clip may be used to secure the second member to a golfer's hat or other article. Preferably, the clip is integrally formed with the base of the second member.

It should be noted that a magnet should be included within the first base to attract the metallic member in the second base, or alternatively, that a magnet should be included within the second base to attract the metallic member in the first base.

In the preferred embodiment, the base of the first member and the base of the second member are each generally circular and of approximately the same diameter as each other. The magnet provided in the base of the first member is preferably a Neodymium (NdFeB) disk. The metallic member provided in the base of the second member is also preferably disk-shaped, and is ideally a second Neodymium (NdFeB) magnet. Since the base of the first member and the base of the second member are releasably secured to each other by magnetic coupling, the first member may easily be rotated relative to the second member, thereby allowing a cigar secured to the first member to be oriented in a position which avoids distraction to the user while golfing or engaging in other activities.

Another aspect of the present invention relates to a method of supporting a cigar from a user's hat being worn upon a user's head. In practicing such method, a cigar retainer is secured to a first base; preferably, this step includes forming the retainer to be integral with the first base. A magnet is also secured to the first base. The user releasably secures the cigar retainer about the cigar; preferably, the retainer surrounds a portion of the cigar extending through an angular arc of at least 200 degrees. A clip is secured to a second base which includes a metallic member; ideally, the clip is formed integrally with the second base. The user couples the clip around a portion of the user's hat, preferably to a visor portion, or brim, of the user's hat. The user then positions the first base proximate to the second base for forming a magnetic coupling therebetween, for allowing the cigar to be releasably supported from the user's hat. The user may rotate the first base relative to the second base to easily adjust the orientation of the cigar relative to the user's hat and/or head. When a user desires to smoke the cigar, the user simply pulls the first base from the second base, breaking the magnetic coupling therebetween, and freeing the cigar for smoking.

DETAILED DESCRIPTION OF THE PREFERRED EMBODIMENT

Figure 1:
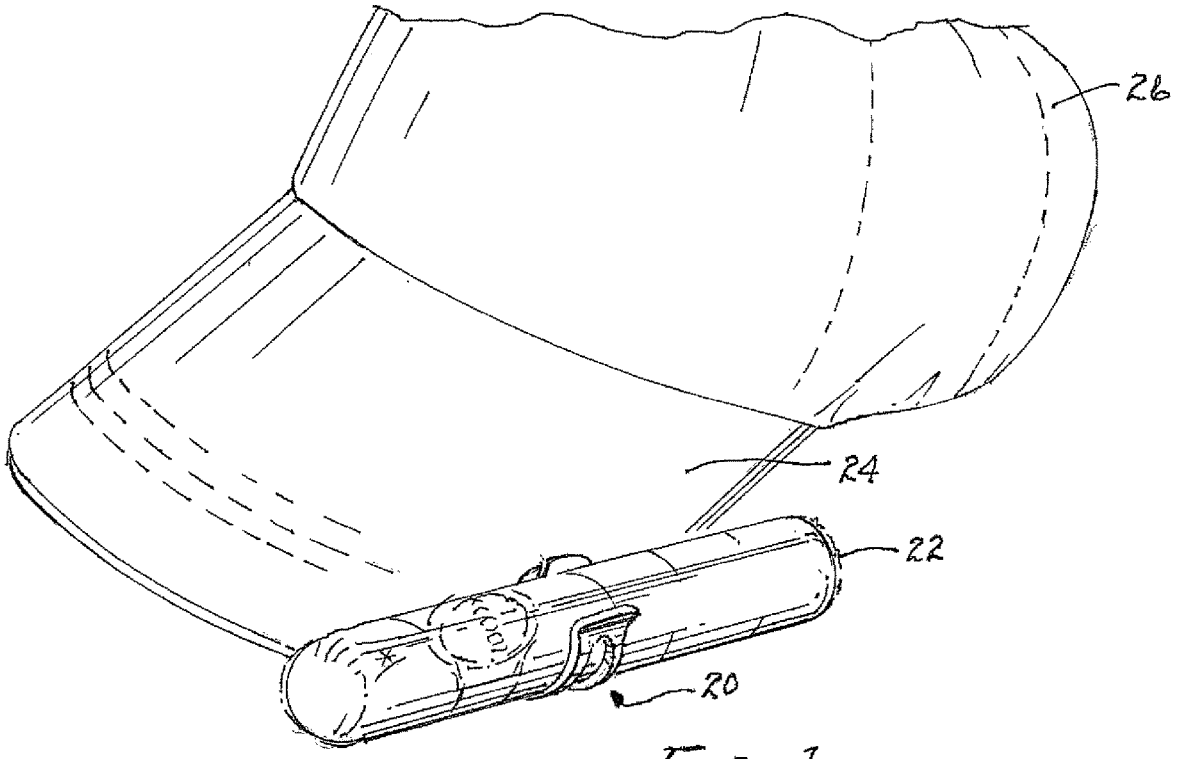
FIG. 1 is a perspective view of a golfer's hat, a cigar, and a cigar holder for releasably securing the cigar to the user's hat in accordance with the teachings of the present invention.
Figure 2:
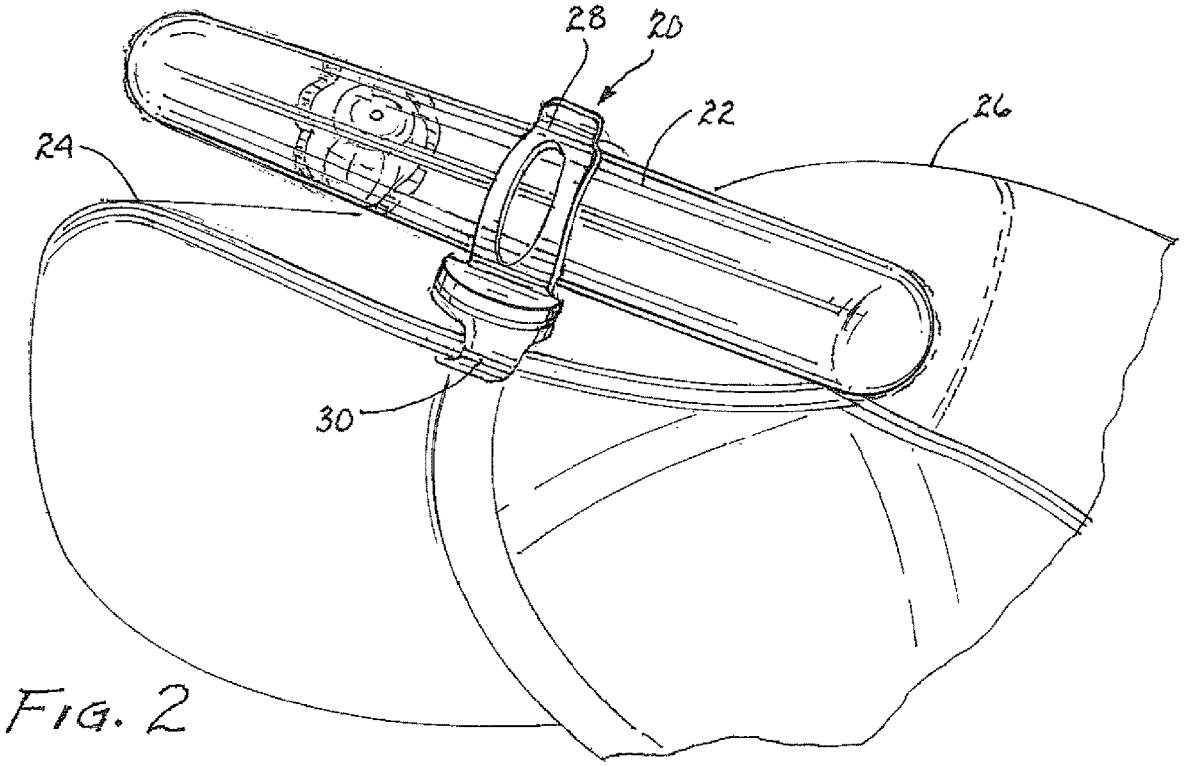
FIG. 2 is a perspective view of the assembly shown in FIG. 1, viewed from below the hat, and illustrating the first and second members of the cigar holder.

A preferred form of a cigar holder constructed in accordance with the teachings of the present invention is designated generally in FIG. 1 and by reference numeral 20. Cigar 22 is releasably secured within cigar holder 20. In turn, cigar holder 20 is clipped to the brim/visor portion 24 of golfer's hat 26. As shown in FIG. 2, cigar holder 20 is formed by two components, namely, a first member, or cigar portion, 28, and a second member, or hat portion, 30.

Figure 3:
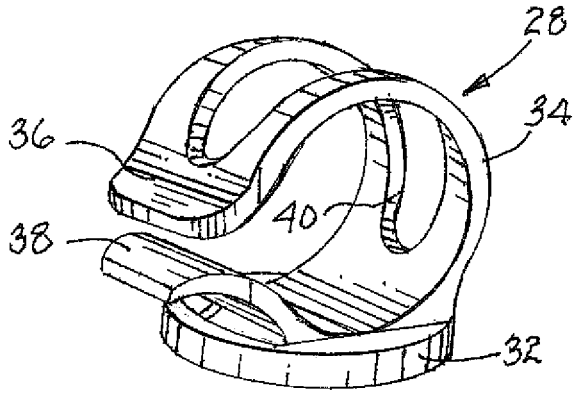
FIG. 3 is a perspective view of the first member, or cigar portion, of the cigar holder shown in FIGS. 1 and 2.
Figure 4:
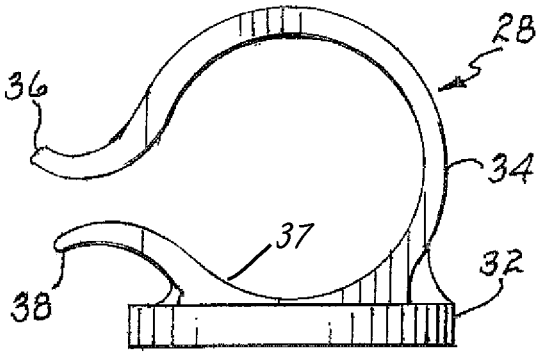
FIG. 4 is a side view of the first member shown in FIG. 3.
Figure 5:
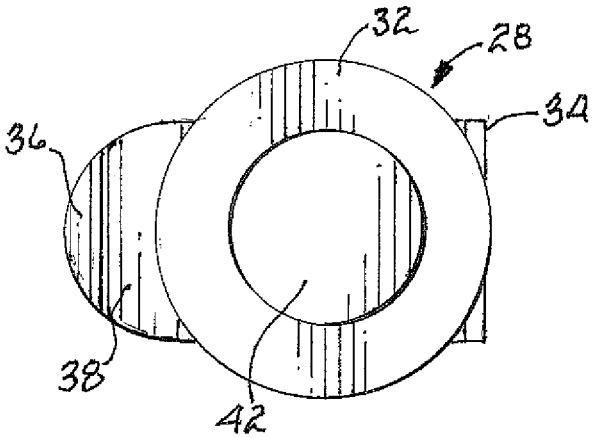
FIG. 5 is a bottom view of the first member shown in FIGS. 3 and 4.

Referring now to FIGS. 3, 4 and 5, first member 28 of cigar holder 20 includes a first base 32. As shown best in FIG. 5, first base 32 is generally circular and includes a first magnet 42 in the form of a disk. It is preferred that first magnet 42 is a Neodymium (NdFeB) disk magnet, measuring approximately ⅜ inch in diameter, and approximately 1/32 inch thick, of the general type available from K&J Magnetics, Inc. of Pipersville, Pa. Magnet 42 may be easily secured to base 32 of first member 28 by a strong adhesive, e.g., one drop of Cyanoacrylate adhesive sometimes sold under the trademarks "Super Glue" and/or "Krazy Glue".

First member 28 also includes a cigar retainer 34 secured to first base 32 and adapted to releasably extend about cigar 22 (see FIGS. 1 and 2). Retainer 34 is preferably provided in the form of a split band having opposing lips 36 and 38 through which cigar 22 may be inserted and removed. It is desired that retainer 34 be flexible and resilient. Toward that end, retainer 34 is preferably made from flexible plastic material, like nylon, which is resilient, and has a "memory" to return to its original configuration after being deformed. In the preferred embodiment, retainer 34 is formed integrally with first base 32 as a one-piece structure; only magnet 42 must be added thereto. As shown best in FIG. 4, the first base of the first member includes a generally concave saddle 37 for supporting and partially extending around the cigar.

It is preferred that retainer 34 sweeps through an angular arc measuring at least 200 degrees in order to sufficiently grasp cigar 22 therein. Also, as shown in FIG. 28, a central portion 40 of the band forming retainer 34 is preferably void, or hollowed, between base 32 and lip 36 to allow retainer 34 to be even more flexible and resilient. Cigar retainer 34 is flexible and resilient enough to reliably secure cigars of widely varying diameters, while avoiding damage to a cigar that would result from excessive compression. In addition, cigar retainer 34 is flexible enough to allow a user to easily slide first member 28 along cigar 22 as the cigar burns down while it is smoked.

Figure 6:
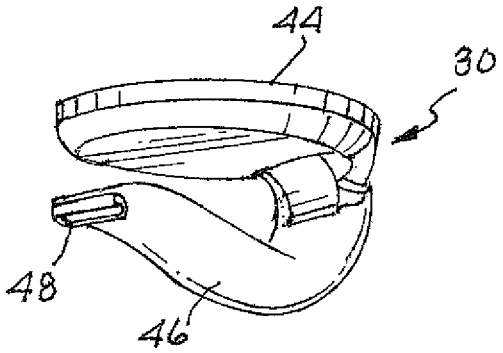
FIG. 6 is a perspective view of the second member, or hat portion, of the cigar holder shown in FIGS. 1 and 2.
Figure 7:
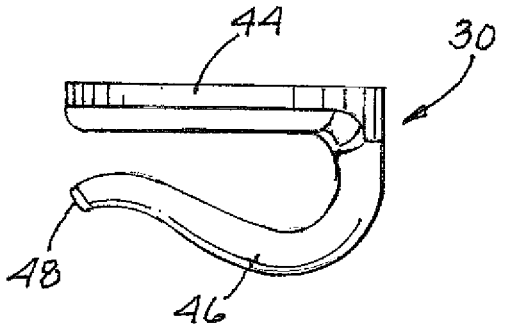
FIG. 7 is a side view of the second member shown in FIG. 6.
Figure 8:
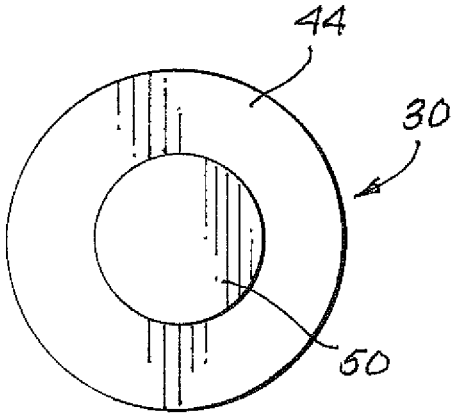
FIG. 8 is a bottom view of the second member shown in FIGS. 6 and 7.

Referring now to FIGS. 6, 7 and 8, second member 30 includes a second base 44, which is preferably circular, and of substantially the same diameter as first base 32. As shown best in FIG. 8, second base 44 includes a disk-shaped metallic member 50 for being attracted to magnet 42 included in first base 32. A clip 46 is secured to, and extends from, second base 44, for allowing a user to engage second member 30 with the brim of the user's golfing hat or another article of clothing, if desired. Clip 46 is preferably formed integrally with second base 44. Second base 44 and clip 46 may be formed of the same flexible, resilient plastic, e.g., nylon, used to form first member 28. If desired, the tip 48 of clip 46 may be enlarged and/or knurled to make it easier to open when attaching second member 30 to a hat or other article.

In the preferred embodiment, metallic disk 50, secured to the bottom of second base 44, is actually a second Neodymium (NdFeB) disk magnet, similar to first magnet 42. First base 32 and second base 44 may be releasably secured to each other by bringing first base 32 proximate to second base 44, thereby creating a magnetic coupling between magnet 42 and disk 50. This magnetic coupling is sufficient to retain first member 28 secured to second member 30 during use, while still permitting a user to detach first member 28 from second member 30 in order to smoke cigar 22. In addition, the magnetic coupling between magnet 42 and disk 50 allows a user to easily rotate first member 28, and cigar 22 supported thereby, relative to second member 30, thereby allowing the user to orient cigar 22 into a position which avoids distraction to the user while golfing or engaging in other activities.

While it is preferred that first member 28 be used in conjunction with second member 30, it should be understood that first base 32 may, if desired, be temporarily secured, via magnetic attraction, to virtually any ferrous metal surface, e.g., a steel structural member of a golf cart, to support cigar 22. The primary advantage of using first member 28 together with second member 30 is that the user will always have cigar 22 handy wherever the user may be (e.g., at the tee, on the putting green, etc.), and the user will avoid the problem of resting cigar 22 somewhere else and then driving off without it.

The method of using the aforementioned cigar holder should, by now, be apparent to those skilled in the art. A user can easily support cigar 22 from brim 24 of the user's hat 26 (see FIGS. 1 and 2) by securing retainer 34 to first base 32; securing magnet 42 to the bottom of first base 32; releasably securing retainer 34 about the cigar, preferably by surrounding a portion of cigar 22 by retainer 34 through an angular arc of at least 200 degrees; securing clip 46 to second base 44; coupling clip 46 to the user's hat 26, preferably to brim 24 thereof; and positioning the bottom of first base 32 proximate to the bottom of second base 44 for magnetically coupling the bottom of first base 32 to the bottom of second base 44. As already explained, the user may then rotate first member 28 relative to second member 30 for adjusting the angular orientation of cigar 22 relative to the user's head and hat. When the user wants to hold and/or smoke cigar 22, it is a simple matter to detach first base 32 from second base 44.

Those skilled in the art will now appreciate that a simple and inexpensive cigar holder has been described which conveniently supports a cigar upon the user's hat when the user is otherwise occupied. Use of the described cigar holder virtually eliminates the possibility that the user will inadvertently forget the cigar while golfing or engaging in other activities. The cigar is safely supported off, and away from, the turf, thereby avoiding any toxic landscaping chemicals, insects, etc., and also avoiding moisture that would damage the cigar wrapping. The disclosed cigar holder permits a golfer to bring the cigar to the tee, to the putting green, and/or to the fairway location where a ball has been shot, whereby the cigar is always at hand. Nonetheless, when the user requires both of his or her hands, the cigar can be quickly and easily returned to its supported position upon the user's hat. The magnetic coupling between the cigar retainer and the hat clip allows the user to easily orient the cigar into a position that is not distracting to the user, while allowing the user to easily retrieve the cigar for smoking after the user has taken his or her golf shot.

While the present invention has been described with respect to preferred embodiments thereof, such description is for illustrative purposes only, and is not to be construed as limiting the scope of the invention. For example, as noted above, while the preferred embodiment has been described as incorporating a magnet within the base of the first member (the cigar retainer), it would be possible to instead incorporate a magnet within the base of the second member (the hat clip) and insert a non-magnetized metallic member within the base of the first member, if so desired. Various other modifications and changes may be made to the described embodiments by those skilled in the art without departing from the true spirit and scope of the invention as defined by the appended claims.

We claim:

1. A cigar holder comprising in combination:

a) a first member including a first base, the first member further including a retainer secured to, and integral with, the first base to form a one-piece structure therewith, the retainer including a split band adapted to releasably extend about a cigar for securing the cigar to the first member, the first base including a generally planar base surface of a first surface area;

b) a first magnet having a generally planar magnet surface of a second surface area secured to the generally planar base surface of the first base of the first member;

c) the first surface area being at least as large as the second surface area; and d) a second member having a second base, the second base including a metallic member for being attracted to the first magnet and for releasably securing the second base to the first base when the second base is brought proximate to the first base, the second member including a clip secured to the second base and adapted to couple the second member to a hat.

2. The cigar holder recited by claim 1 wherein the first base and second base are releasably secured to each other by magnetic coupling, the magnetic coupling allowing the first member to be rotated easily relative to the second member, thereby allowing a cigar secured to the first member to be oriented in a position which avoids distraction to the user while golfing or engaging in other activities.

3. The cigar holder recited by claim 1 wherein the retainer of the first member is made from flexible plastic material.

4. The cigar holder recited by claim 3 wherein the flexible plastic material is nylon.

5. The cigar holder recited by claim 3 wherein the flexible plastic material is resilient, and has a "memory" to return to its original configuration after being deformed.

6. The cigar holder recited by claim 1 wherein the split band of the retainer of the first member sweeps through an angular arc measuring at least 200 degrees.

7. The cigar holder recited by claim 1 wherein the first magnet is a Neodymium (NdFeB) disk, and wherein the metallic member of the second member is a generally circular disk.

8. The cigar holder recited by claim 1 wherein:

a) the first magnet is a Neodymium (NdFeB) disk; and b) the metallic member included within the second base of the second member is also a Neodymium (NdFeB) disk.

9. The cigar holder recited by claim 1 wherein the first base and second base are each generally circular.

10. The cigar holder recited by claim 1 wherein the clip secured to the second base is integrally formed with the second base.

11. A cigar holder comprising in combination:

a) a first component including a first base, the first component further including a retainer secured to, and integral with, the first base to form a one-piece structure therewith, the retainer including a split band adapted to releasably extend about a cigar for securing the cigar to the first component, the first base including a generally planar base surface of a first surface area;

b) a first metallic member secured to the first base, the first metallic member having a generally planar surface of a second surface area;

c) the first surface area being at least as large as the second surface area;

d) a second component having a second base, the second component including a clip secured to the second base and adapted to couple the second component to an article of clothing;

e) a second metallic member secured to the second base; and f) at least one of said first and second metallic members being a magnet for providing a magnetic coupling between such first and second metallic members, and for releasably securing the first base to the second base when the first base is brought proximate to the second base.

12. The cigar holder recited by claim 11 wherein:

a) the retainer of the first component is made from flexible plastic material; and b) the clip of the second component is made from flexible plastic material.

13. The cigar holder recited by claim 1 wherein the first base of the first member includes a generally concave saddle for supporting and partially extending around the cigar.

14. The cigar holder of claim 11 wherein the first base of the first component includes a generally concave saddle for supporting and partially extending around the cigar.

15. The cigar holder recited by claim 1 wherein the split band of the retainer of the first member includes opposing lips through which a cigar may be inserted into, and removed from, the retainer.

16. The cigar holder recited by claim 11 wherein the split band of the retainer of the first component includes opposing lips through which a cigar may be inserted into, and removed from, the retainer.

* * * * *